US008579528B2

(12) United States Patent
Yamada

(10) Patent No.: US 8,579,528 B2
(45) Date of Patent: Nov. 12, 2013

(54) THERMAL PRINTER

(75) Inventor: Rikuo Yamada, Yamagata-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/345,212

(22) Filed: Jan. 6, 2012

(65) Prior Publication Data

US 2012/0105568 A1 May 3, 2012

Related U.S. Application Data

(63) Continuation of application No. 11/811,841, filed on Jun. 12, 2007, now abandoned.

(30) Foreign Application Priority Data

Jun. 12, 2006 (JP) ..... 2006-161996

(51) Int. Cl.
*B41J 11/24* (2006.01)

(52) U.S. Cl.
USPC ..... 400/660.2; 400/660; 400/660.1

(58) Field of Classification Search
USPC ..... 400/660.2
See application file for complete search history.

(56) References Cited

U.S. PATENT DOCUMENTS

| | | | | |
|---|---|---|---|---|
| 1,625,891 | A | 4/1927 | Hokanson | |
| 2,230,677 | A * | 2/1941 | Beiderbecke | 400/649 |
| 2,729,323 | A | 1/1956 | Jones | |
| 2,880,839 | A * | 4/1959 | Messner et al. | 400/660.2 |
| 3,154,184 | A | 10/1964 | Gallant et al. | |
| 4,522,121 | A | 6/1985 | Denzin et al. | |
| 4,802,795 | A | 2/1989 | Takada | |
| 4,848,945 | A | 7/1989 | Sone | |
| 4,936,697 | A | 6/1990 | Weller et al. | |
| 5,139,351 | A | 8/1992 | Kamada | |
| 5,746,520 | A | 5/1998 | Kohira | |
| 6,011,571 | A * | 1/2000 | Lardant et al. | 347/197 |
| 6,249,302 | B1 | 6/2001 | Sekiya | |
| 6,718,876 | B1 * | 4/2004 | Williamsson | 101/479 |
| 6,744,457 | B2 * | 6/2004 | Seino et al. | 347/220 |
| 7,165,903 | B2 | 1/2007 | Naito | |
| 7,572,001 | B2 | 8/2009 | Ito | |
| 2002/0021927 | A1 | 2/2002 | Mori et al. | |
| 2005/0207818 | A1 | 9/2005 | Tsuchiya et al. | |
| 2007/0286659 | A1 | 12/2007 | Yamada | |

FOREIGN PATENT DOCUMENTS

| | | | |
|---|---|---|---|
| EP | 1323535 | A2 | 7/2003 |
| JP | 61291157 | A | 12/1986 |
| JP | 03199069 | A | 8/1991 |

(Continued)

OTHER PUBLICATIONS

Office Action dated Apr. 28, 2011 in U.S. Appl. No. 11/811,841.

(Continued)

*Primary Examiner* — Jill Culler
(74) *Attorney, Agent, or Firm* — Nutter McClennen & Fish LLP; John J. Penny, V.; Christina M. Sperry

(57) ABSTRACT

The platen bearings attached to the shaft end parts of the removable platen roller are pressed by lock levers to bearing insertion slots that are formed in the main frame of the thermal printer so that the positions of the platen bearings are determined by two points on the main frame and one point on the lock lever.

6 Claims, 5 Drawing Sheets

(56) References Cited

FOREIGN PATENT DOCUMENTS

| | | | |
|---|---|---|---|
| JP | 04016375 | A | 1/1992 |
| JP | 05212923 | A | 8/1993 |
| JP | 09086011 | A | 3/1997 |
| JP | 11151847 | A | 6/1999 |
| JP | 2000318260 | A | 11/2000 |
| JP | 2002144611 | A | 5/2002 |
| JP | 2003127445 | A | 5/2003 |
| JP | 2003200624 | A | 7/2003 |
| JP | 2005271204 | A | 10/2005 |

OTHER PUBLICATIONS

Office Action dated Dec. 22, 2009 in U.S. Appl. No. 11/811,841.
Office Action dated Jun. 16, 2010 in U.S. Appl. No. 11/811,841.
Office Action dated Oct. 19, 2011 in U.S. Appl. No. 11/811,841.

* cited by examiner

THERMAL PRINTER

BACKGROUND OF THE INVENTION

1. Field of Invention

The present invention relates to a thermal printer that has a platen roller to which a thermal head is pressed and which is removably installed to the main frame of the printer, and relates more particularly to a thermal printer that has a mechanism for precisely positioning the removable platen roller to the main frame.

2. Description of Related Art

The thermal head in a line thermal printer has a printing surface that covers the full width of the printable line, and is urged from behind against the platen roller by a head pressure spring. In order to replace the thermal paper or other printing paper or clean the print head, the thermal head must be separated from the platen roller and held with a gap between the thermal head and the platen roller so that the new paper can be passed between the thermal head and the platen roller or the thermal head can be cleaned, see for example, Japanese Unexamined Patent Appl. Pub. JP-A-2000-318260 teaches a removable platen roller that can be completely removed from the main frame of the thermal printer so that these tasks can be completed easily.

With the thermal printer taught in JP-A-2000-318260, the bearings attached to the opposite ends of the platen roller shaft can be inserted into and removed from slots formed in the main frame. The thermal head and a lock arm are also supported to pivot in opposite directions on a common support shaft. A head pressure spring is disposed between the thermal head and the lock arm, and the bearings that are on the ends of the platen roller shaft and inserted to these slots are pressed and held by the thermal head against the inside end surface of the slots and the curved surface of the lock arm by the force of the head pressure spring.

The position of the removable platen roller in this thermal printer is determined by the platen roller being held between the point of contact between the bearing and the curved end surface of the lock arm and the point of contact between the thermal head and the platen roller, and being fit into the slots in the main frame. The lock arm and the thermal head are attached to the main frame so that the lock arm and the thermal head can pivot. As a result, when the positions of the lock arm and the thermal head change, the position of the platen roller to the main frame also changes. This can prevent precisely positioning the platen roller to the main frame.

A driven gear to which torque is transferred through a speed reducing gear train from a paper feed motor disposed to the main frame is coaxially disposed to the end part of the platen roller shaft. The platen roller must also be precisely positioned to the main frame in order for the driven gear of the platen roller to consistently mesh accurately with the drive gear at the last stage of the speed reducing gear train that is disposed to the main frame.

Because the related art cannot precisely position the removable platen roller to the main frame in certain cases, the driven gear may not mesh properly with the drive gear when the platen roller is installed to the main frame.

SUMMARY OF THE INVENTION

The thermal printer of the invention enables precisely positioning a removable platen roller to the main frame.

A thermal printer according to a first preferred aspect of the invention has a main frame; a thermal head; a platen roller; a head urging member that urges the thermal head to the platen roller; a platen bearing attached to each end of a roller shaft that protrudes coaxially from both ends of the platen roller; bearing insertion slots that are formed in the main frame and in which the platen bearings are removably inserted; a lock lever that can move from a locked position for locking and preventing the platen bearings from leaving the bearing insertion slots in an unlocked position enabling removal of the platen bearings from the bearing insertion slots; and a lever urging member that constantly urges the lock lever to the locked position. The platen bearings are pressed against an inside edge of the bearing insertion slots and positioned against the main frame by the lock lever when the lock lever is in the locked position.

Preferably, the contour of the inside edge of each bearing insertion slot is shaped to contact the outside diameter surface of the cylindrical platen bearing at two points; and the contour of the contact surface of the lock lever that contacts the platen bearing is shaped to contact the outside diameter surface of the platen bearing at one point.

When the removable platen roller is locked in the bearing insertion slots of the main frame in the thermal printer of this preferred aspect of the invention, the platen bearings of the platen roller are pressed against the inside edges of the bearing insertion slots by the lock levers. By desirably shaping the inside edge to typically contact the outside surface of the platen bearing at two points, the platen bearing can be positioned to the main frame. As a result, the driven gear that is disposed to the end of the platen roller shaft can reliably mesh with the drive gear that is disposed on the main frame.

The head urging member in the thermal printer urges the platen roller by means of the intervening thermal head in the direction in which the platen bearing separates from the inside edge of the bearing insertion slot. In resistance to this urging force, the lock lever must hold the platen bearing pressed against the inside edge of the bearing insertion slot in the main frame. The urging force of the lever urging member is therefore set so that when the lock lever is in the locked position, the urging force of the head urging member that acts by means of the intervening platen bearing does not cause the lock lever to move from the locked position.

By suitably setting the shape of the bearing insertion slot, the urging force of the head urging member can be used to push the platen bearing from the bearing insertion slot when the lock lever moves to the unlocked position. This simplifies removing the platen roller.

Further preferably, the thermal printer also has a manually operated lock release lever for moving the lock lever to the unlocked position. By providing a lock release lever, the lock lever can be easily moved and the platen roller can be easily removed.

Further preferably, the lock lever is disposed on the main frame so that the lock lever can pivot on a support shaft extending parallel to the platen roller shaft. The lock lever has a connecting member for the lever urging member formed on one side of the support shaft, and on the other side of the support shaft has a hook for pushing the platen bearing into the bearing insertion slot. The thermal head is attached to the main frame on the opposite side of the platen roller as the hook so that the thermal head can pivot on the support shaft. When the lock lever is in the locked position, the bottom of the bearing insertion slot, the side surface of the bearing insertion slot on the thermal head side, and the edge of the hook of the lock lever each contact the outside of the platen roller shaft.

So that the lock lever can hold the platen bearing pressed against the inside edge of the bearing insertion slot in the main frame in resistance to the urging force of the head urging member, the urging force of the lever urging member is set so that when the lock lever is in the locked position, the urging force of the head urging member that acts by means of the intervening platen bearing does not cause the lock lever to move from the locked position.

If the side surface on the hook side of the bearing insertion slot is an inclined surface forming an angle of 90 degrees or more to the slot bottom, the urging force of the head urging member can push the platen roller shaft along the inclined surface from the bearing insertion slot when the lock lever moves to the unlocked position.

If the thermal printer also has a lock lever frame having a lock lever formed on both end parts, and a manual operating member is disposed to the lock lever frame, the lock lever frame can be used as a manually operated lock release lever.

Further alternatively, the lock release lever can be a member that is attached to the main frame so that the lock release lever can pivot on the support shaft.

In a thermal printer according to a preferred aspect of the present invention, platen bearings that are attached to the ends of the shaft of the removable platen roller are pressed against the inside circumference edges of bearing insertion slots formed in the main frame so that the position of each platen bearing is determined by three points, two on the main frame and one on the lock lever. The platen roller is thus unconditionally positioned on the main frame and the position of the platen roller relative to the main frame does not vary. The driven gear attached to the end of the platen roller shaft can thus always reliably mesh with the drive gear disposed to the main frame.

Other objects and attainments together with a fuller understanding of the invention will become apparent and appreciated by referring to the following description and claims taken in conjunction with the accompanying drawings.

DESCRIPTION OF THE PREFERRED EMBODIMENTS

A preferred embodiment of the present invention is described below with reference to the accompanying figures.

Figure 1:
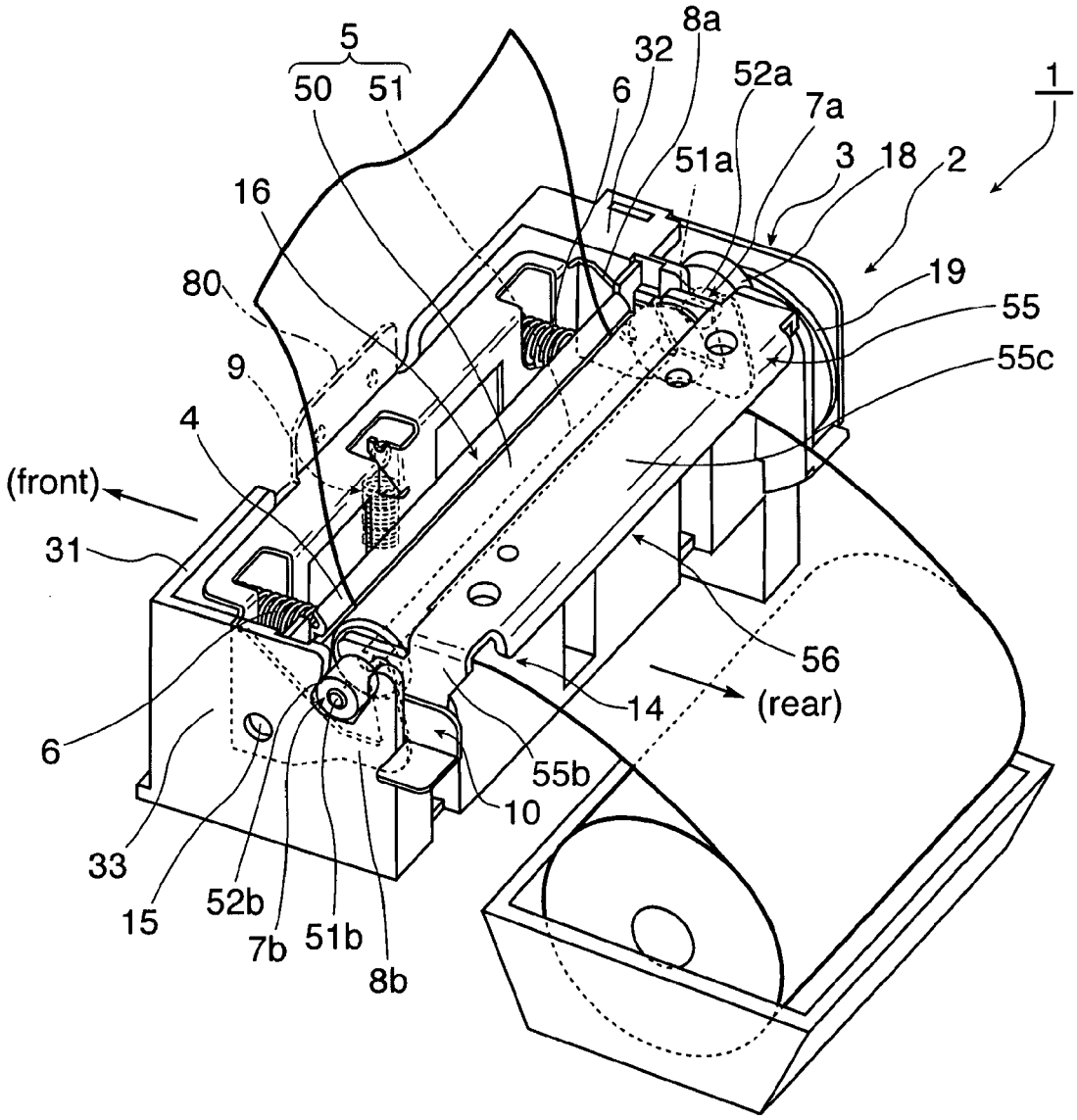
FIG. 1 is an oblique view showing the print mechanism unit of a thermal printer according to a preferred embodiment of the present invention.
Figure 2:
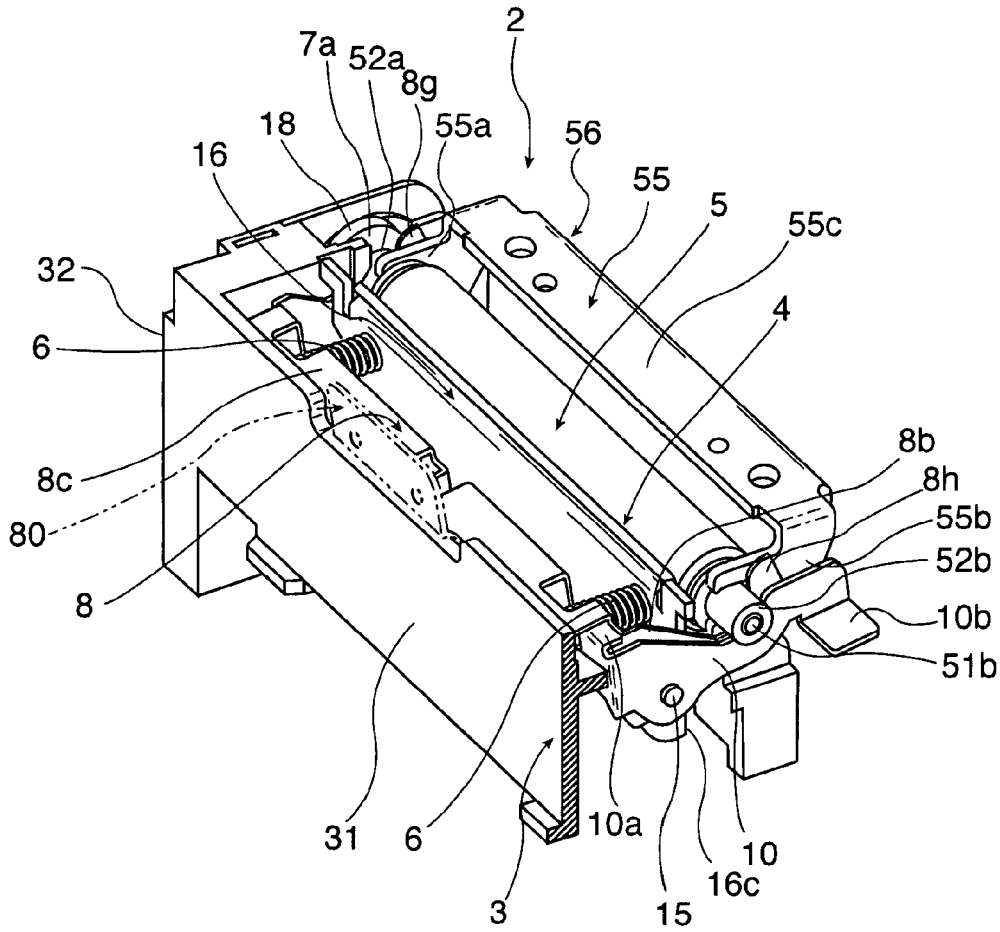
FIG. 2 is an oblique view showing the print mechanism from a different direction with a portion of the print mechanism removed.
Figure 3:
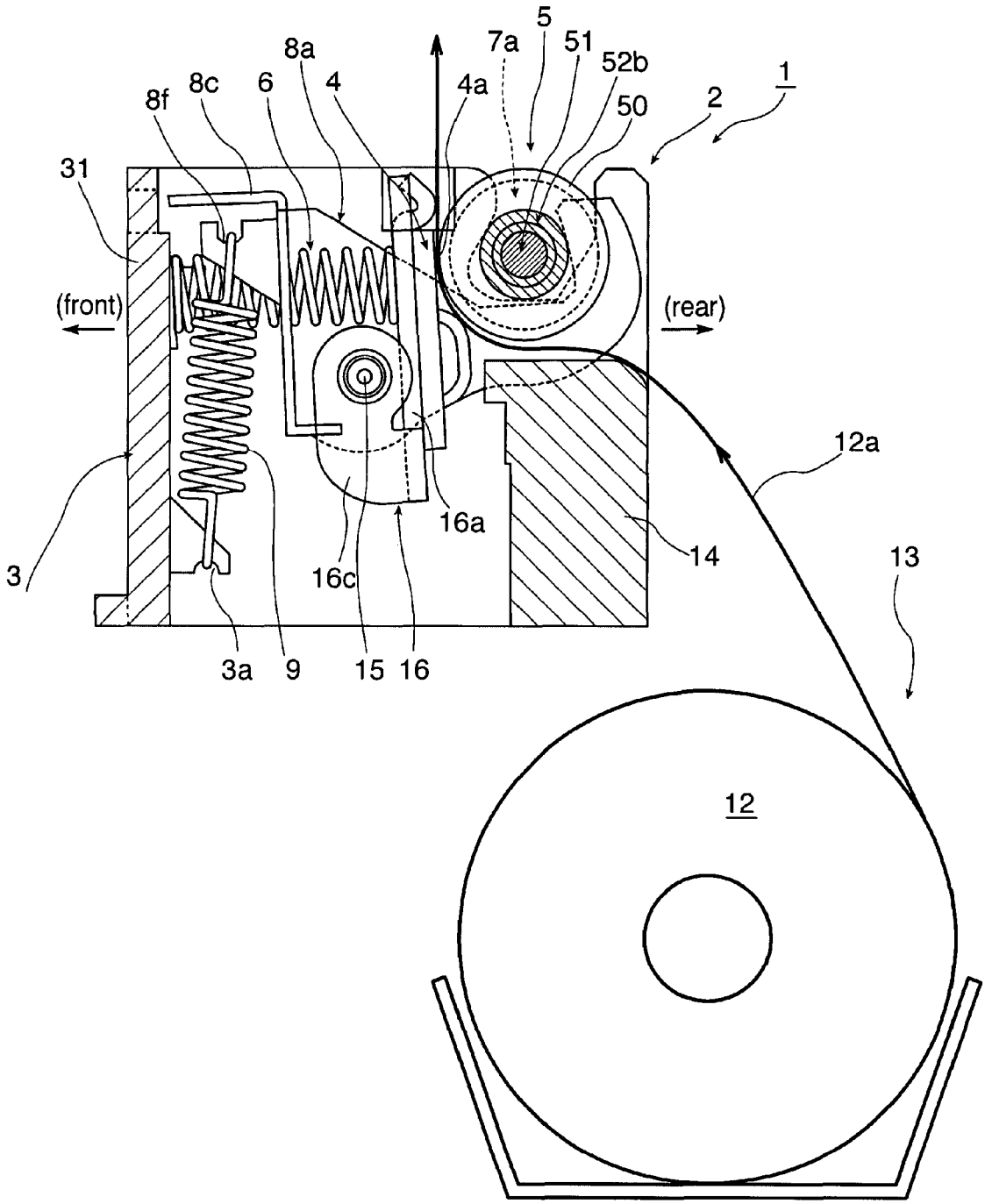
FIG. 3 is a schematic section view of the print mechanism unit.

FIG. 1 is an oblique view showing the print mechanism unit of a thermal printer according to the present invention. FIG. 2 is an oblique view showing the print mechanism from a different direction with a portion of the print mechanism removed. FIG. 3 is a schematic section view of the print mechanism unit.

As shown in these figures, the print mechanism unit 2 of the thermal printer 1 has a main frame 3, a thermal head 4 that is installed to the main frame 3, and a removable platen roller 5 that is removably installed to the main frame 3. The thermal head 4 is a line thermal head disposed extending widthwise to the printer with a print surface 4*a* that spans the entire printable width of the print head. The platen roller 5 is also installed widthwise to the printer and in contact with the print surface 4*a*. A head pressure spring 6 pushes the thermal head 4 from behind against the platen roller 5.

The end parts 51*a*, 51*b* of the roller shaft 51 protrude coaxially from the opposite end faces of the removable platen roller 5, and cylindrical platen bearings 52*a*, 52*b* are attached to these shaft end parts 51*a*, 51*b*. These platen bearings 52*a*, 52*b* are removably inserted through right and left bearing insertion slots 7*a*, 7*b* that are formed in the main frame 3, and the platen roller 5 is supported freely rotatably on the main frame 3 by these platen bearings 52*a*, 52*b*.

The platen bearings 52*a*, 52*b* are locked by the right and left lock levers 8*a*, 8*b* so that the platen bearings 52*a*, 52*b* do not escape from the bearing insertion slots 7*a*, 7*b*. The lock levers 8*a*, 8*b* are constantly urged by a tension spring 9 in the direction locking the platen bearings 52*a*, 52*b* in the bearing insertion slots 7*a*, 7*b*.

A manually operated lock release lever 10 for releasing the lock levers 8*a*, 8*b* from the locked position is connected to the lock levers 8*a*, 8*b*. When the lock release lever 10 is operated against the urging force of the tension spring 9, the lock levers 8*a*, 8*b* are released from the locking position and the platen bearings 52*a*, 52*b* can be removed from the bearing insertion slots 7*a*, 7*b*. As a result, the platen roller 5 can be removed from the main frame 3.

Thermal paper 12*a* is pulled through the position (the printing position) where the thermal head 4 and the platen roller 5 are pressed together. More specifically, the thermal paper 12*a* is pulled from a roll paper compartment 13 that holds roll paper 12 having a web of thermal paper 12*a* wound into a roll, is guided to the printing position by a paper guide 14 disposed on the main frame 3, and is conveyed passed the printing position and discharged from the printer from a paper exit not shown. Content can be printed on the thermal paper 12*a* by selectively driving the heat elements arrayed on the print surface 4*a* of the thermal head 4 while rotating the platen roller 5 to advance the thermal paper 12*a*.

The arrangement of the parts of the print mechanism unit 2 is described next. The main frame 3 has a vertical front panel 31 extending widthwise to the printer, and left and right vertical side panels 32, 33 that extend substantially perpendicularly from the opposite ends of the vertical front panel 31 towards the back of the printer. FIG. 2 shows the print mechanism unit 2 with the one vertical side panel 33 omitted. The paper guide 14 extends widthwise to the printer between the bottom rear end parts of the vertical side panels 32, 33.

A support shaft 15 is disposed widthwise to the printer between the left and right vertical side panels 32, 33. Alternatively, support pins could be affixed at the same positions to the vertical side panels 32, 33. A head support frame 16 is supported on the support shaft 15 so that the head support frame 16 can rock in the front-rear direction of the printer on the support shaft 15.

The head support frame 16 has a head support panel 16*a* that extends widthwise to the printer, and left and right arm parts 16*b*, 16*c* that are bent towards the front of the printer from the opposite ends of the head support panel 16*a*. The arm parts 16*b*, 16*c* (only the one arm part 16*c* is shown in the figures) are supported rotatably on the support shaft 15. The thermal head 4 is attached to the surface of the head support panel 16*a* facing the rear of the printer so that the print surface 4*a* faces the rear of the printer. The head pressure spring 6 is connected extending in the front-rear direction of the printer between the head support panel 16*a* and the vertical front panel 31 of the main frame 3 at a position above the support shaft 15. Two head pressure springs 6, one each on the left and right sides of the printer, are provided in this embodiment of the invention.

The platen roller 5 is pressed from the rear side of the printer to the print surface 4*a* of the thermal head 4. The platen roller 5 includes a cylindrical roller 50 made from an elastic material, and a roller shaft 51 that is attached to the roller 50 and passes coaxially through the roller 50. The shaft end parts 51*a*, 51*b* at the opposite ends of the roller shaft 51 protrude from the end surfaces of the roller 50, and a cylindrical platen bearing 52*a*, 52*b* is mounted on each of the shaft end parts 51*a*, 51*b*.

In this aspect of the invention the platen roller 5 is assembled to a unit frame 55. The unit frame 55 has a connecting plate 55*c* extending widthwise to the printer, and arm parts 55*a*, 55*b* bent downward perpendicularly from the opposite ends of the connecting plate 55*c*. The platen bearings 52*a*, 52*b* on the opposite ends of the platen roller 5 are held so that the platen bearings 52*a*, 52*b* can slide in the front-rear direction of the printer on the distal end parts of the arm parts 55*a*, 55*b*. The unit frame 55, the platen roller 5, and the left and right platen bearings 52*a*, 52*b* form a platen roller unit 56, and this platen roller unit 56 is removably installed to the main frame 3.

The driven gear 18 is fixed coaxially to the platen roller 5 on the end of one shaft end part 51*a*. This driven gear 18 meshes with the compound drive gear 19, which is attached freely rotatably on the vertical side panel 32 of the main frame 3. The compound drive gear 19 is connected to the output shaft of a paper feed motor not shown by means of an intervening speed reducing gear train not shown.

Figure 4:
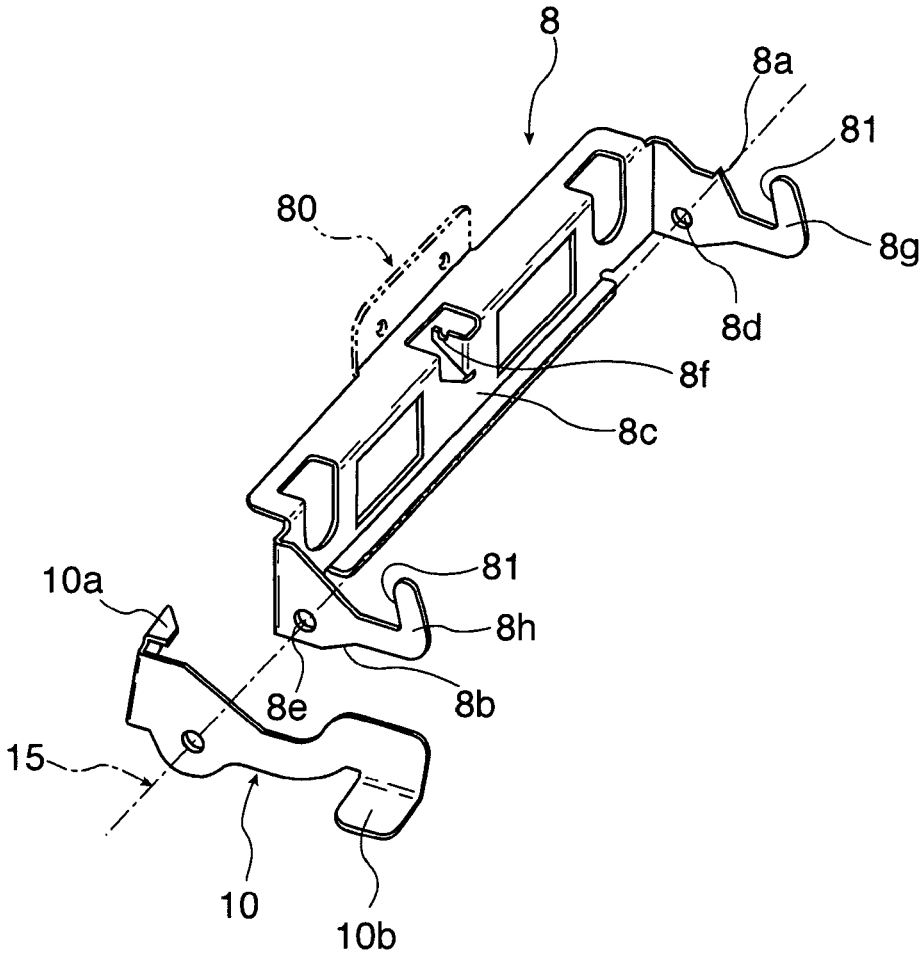
FIG. 4 shows the lock lever frame and the lock release lever.

FIG. 4 is a parts diagram showing the part to which the lock levers 8*a*, 8*b* are formed and the lock release lever 10. The lock levers 8*a*, 8*b* are formed at the left and right ends of the lock lever frame 8. More specifically, the lock lever frame 8 has a connecting plate 8*c* extending widthwise to the printer, and the lock levers 8*a*, 8*b* are bent towards the rear of the printer from the opposite ends of the connecting plate 8*c*. Shaft holes 8*d*, 8*e* are formed in the left and right lock levers 8*a*, 8*b* at an appropriate position towards the front of the printer, and the support shaft 15 (denoted by the imaginary line in FIG. 4) disposed to the main frame 3 passes freely rotatably through these holes 8*d*, 8*e*. The lock lever frame 8 is thus supported by the support shaft 15 so that the lock lever frame 8 can rock vertically to the printer on the support shaft 15. A spring catch 8*f* is formed on the connecting plate 8*c*, which is positioned to the front of the printer from the support shaft 15, in the widthwise center of the printer. Another spring catch 3*a* is formed at a position on the main frame 3 below the spring catch 8*f*, and the tension spring 9 is connected between these catches as shown in FIG. 3.

Hooks 8*g*, 8*h* are formed curving upward from the parts of the lock lever 8*b* toward the rear of the printer from the support shaft 15. The left and right platen bearings 52*a*, 52*b* are pushed towards the front of the printer by the edges of the hooks 8*g*, 8*h* facing the front of the printer, thus rendering a locked position in which the platen bearings 52*a*, 52*b* cannot escape from the bearing insertion slots 7*a*, 7*b*.

As will be known from FIG. 2 and FIG. 4, the lock release lever 10 is supported by the support shaft 15 so that the lock release lever 10 can rock vertically relative to the printer on the support shaft 15. An engaging member 10*a* that contacts the connecting plate 8*c* of the lock lever frame 8 from the front is formed on the lock release lever 10 towards the front of the printer from the support shaft 15. A manual operating member 10*b* is formed bent to the outside widthwise to the printer at a part of the lock release lever 10 to the rear of the printer from the support shaft 15. The center of gravity of the lock release lever 10 is to the rear of the printer from the support shaft 15, and the engaging member 10*a* at the front of the printer therefore always contacts the front side of the connecting plate 8*c* of the lock lever frame 8.

Figure 5A:
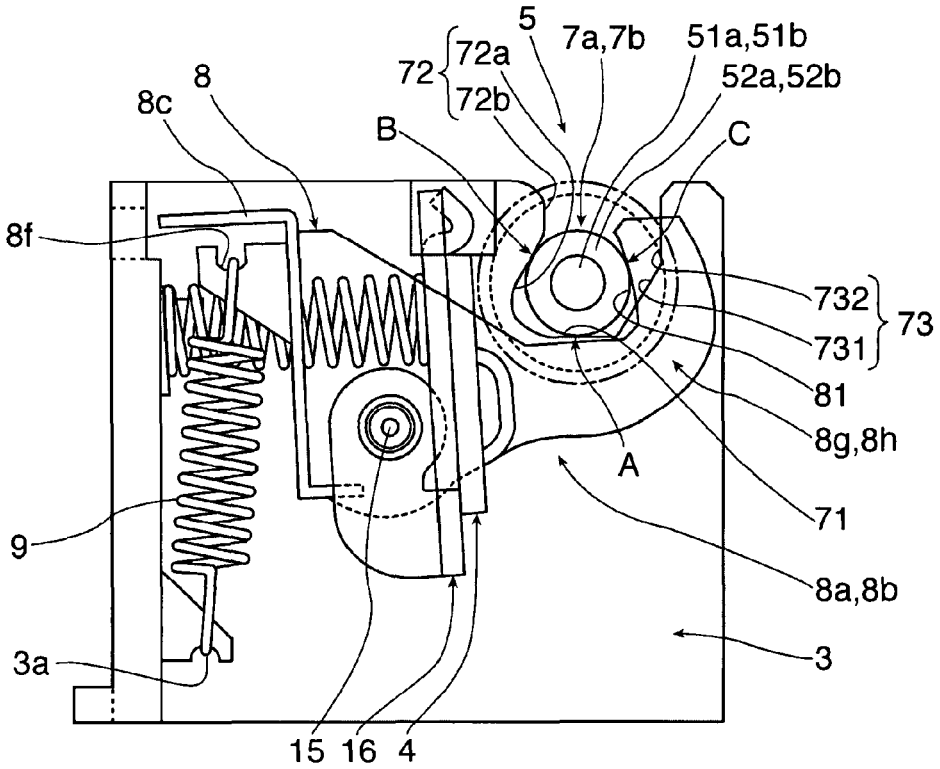
FIG. 5 shows the platen roller in the locked position and the unlocked position.
Figure 5B:
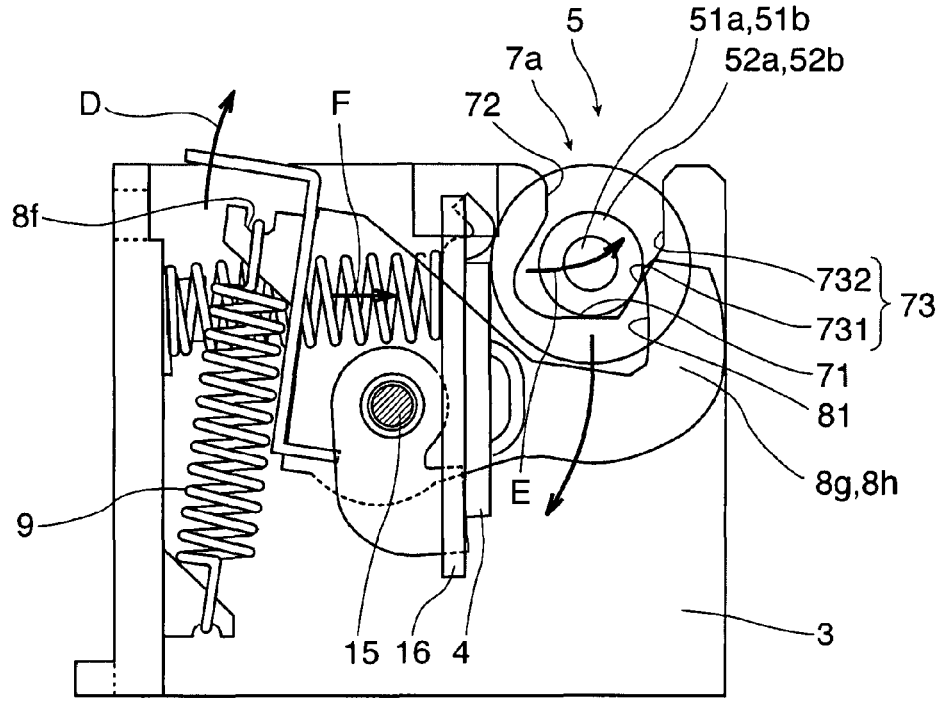

FIG. 5A shows the platen roller 5 in the locked position, and FIG. 5B shows the platen roller 5 in the unlocked position. The profiles of the bearing insertion slots 7*a*, 7*b* and the front edges of the hooks 8*g*, 8*h* of the lock levers 8*a*, 8*b* in this embodiment of the invention are described next with reference to these figures.

The bottom 71 of each of the bearing insertion slots 7*a*, 7*b* is a flat surface extending substantially horizontally in the front-rear direction of the printer. A front slot side 72 and a rear slot side 73 extend from the front and back ends of each slot bottom 71.

Each front slot side 72 has a concave surface part 72*a* that curves toward the front of the printer, and a convex surface part 72*b* that continues smoothly from the top end of the concave surface part 72*a* and projects slightly towards the rear of the printer. The profiles of the slot bottom 71 and the front slot side 72 are set so that the slot bottom 71 and the front slot side 72 respectively contact the outside of the platen bearings 52*a*, 52*b* at points A and B.

The rear slot side 73 of each of the bearing insertion slots 7*a*, 7*b* has an incline part 731 and a incline part 732. The one incline part 731 extends at an angle of greater than 90 degrees from the slot bottom 71. The other incline part 732 curves upward continuously from the top of the first incline part 731. The gap between the front and rear slot sides 72, 73 is greater than the outside diameter of the platen bearings 52*a*, 52*b*, and increases gradually to the top, that is, to the open side of the slot.

The front edge 81 of each of the hooks 8*g*, 8*h* of the lock levers 8*a*, 8*b* has a concave profile that curves slightly towards the rear of the printer and encroaches the front of the printer from the bottom to the top of the curve. The curvature of this concave surface is less than the curvature of the outside diameter of the platen bearings 52*a*, 52*b*. This concave surface is set to contact the outside surface of one of the platen bearings at one point C from the rear of the printer.

In the locked position as shown in FIG. 5A, the lock levers 8*a*, 8*b* are urged upward by the tension spring 9 so that the front edges 81 of the hooks 8*g*, 8*h* of the lock levers 8*a*, 8*b* push the platen bearings 52*a*, 52*b* inserted in the bearing insertion slots 7*a*, 7*b* towards the front of the printer. The platen bearings 52*a*, 52*b* are therefore pushed against the front side 72 and the bottom 71 of the bearing insertion slots 7*a*, 7*b*, and the platen bearings 52*a*, 52*b* are thus positioned by contact at the three points A, B, and C. The platen roller 5 is thus precisely positioned to the main frame 3 when in the locked position.

The thermal head 4 is pressed by the force of the head pressure spring 6 from the front of the printer against the platen roller 5. This pressure pushes the platen roller 5 to the rear of the printer, and pushes the platen bearings 52*a*, 52*b* on the ends of the platen roller 5 in the direction separating from the front slot side 72 of the bearing insertion slots 7*a*, 7*b* of the main frame 3. The tension of the tension spring 9 is therefore set so that when the lock levers 8*a*, 8*b* are in the locked position the hooks 8*g*, 8*h* can hold the platen bearings 52*a*, 52*b* against the front slot side 72 in resistance to the force of the head pressure spring 6.

More specifically, the strength of the tension spring 9 relative to the force of the head pressure spring 6 is set so that when the lock levers 8*a*, 8*b* are in the locked position, the force of the head pressure spring 6 asserted through the platen bearings 52*a*, 52*b* does not cause the lock levers 8*a*, 8*b* to move from the locked position toward the unlocked position.

The lock release lever 10 is operated to remove the platen roller 5 from the main frame 3. Referring to FIG. 5B, when the manual operating member 10*b* of the lock release lever 10 is pushed down using a finger, for example, the engaging member 10*a* of the lock release lever 10 pushes the lock lever frame 8 up as indicated by arrow D. This causes the left and right lock levers 8*a*, 8*b* to pivot down to the unlocked position separated from the outside surface of the platen bearings 52*a*, 52*b*.

The head pressure spring 6 urges the thermal head 4 from the front of the printer to the platen roller 5 as indicated by arrow F in FIG. 5B. As a result, when the lock levers 8*a*, 8*b* separate from the platen bearings 52*a*, 52*b*, the head pressure spring 6 pushes the platen bearings 52*a*, 52*b* toward the rear of the printer inside the bearing insertion slots 7*a*, 7*b*. Because the rear slot side 73 of the bearing insertion slots 7*a*, 7*b* is an incline 731 that slopes upward toward the rear of the printer, the platen bearings 52*a*, 52*b* are pushed upward from the bearing insertion slots 7*a*, 7*b* along the incline part 731 as indicated by arrow E. As a result, when the lock release lever 10 is operated, the force of the head pressure spring 6 automatically pushes the platen roller 5 out from the bearing insertion slots 7*a*, 7*b*. The platen roller 5 can thus be easily removed.

The operation for installing the removed platen roller 5 to the main frame 3 is the same. More specifically, the lock release lever 10 is operated to move the lock levers 8*a*, 8*b* to the unlocked position. The platen bearings 52*a*, 52*b* on the opposite ends of the platen roller are then inserted to the bearing insertion slots 7*a*, 7*b* in the main frame 3. The lock release lever 10 is then released to automatically restore the locked position shown in FIG. 5A.

A lock release lever 10 is provided in this aspect of the invention, but the lock lever frame 8 could instead be used as the lock release lever by disposing a manual operating member to the lock lever frame 8. For example, a manual operating tab 80 could be formed extending upward at the middle of the connecting plate 8*c* of the lock lever frame 8 as indicated by the imaginary lines in FIG. 1, FIG. 2, and FIG. 4. Pushing this manual operating tab 80 to the rear of the printer moves the lock levers 8*a*, 8*b* to the unlocked position.

The thermal printer 1 according to this embodiment of the invention thus presses the platen bearings 52*a*, 52*b* on the opposite ends of the platen roller 5 against the bearing insertion slots 7*a*, 7*b* formed in the main frame 3 to lock and prevent the platen bearings 52*a*, 52*b* from leaving the bearing insertion slots 7*a*, 7*b*. The platen roller 5 can thus be precisely positioned to the main frame 3 because the platen bearings 52*a*, 52*b* are pressed directly against the main frame 3. As a result, the driven gear 18 attached to the shaft end part 51*a*, 51*b* always meshes reliably with the compound drive gear 19 disposed to the main frame 3.

When the lock levers 8*a*, 8*b* move to the unlocked position, the force of the head pressure spring 6 pushes the platen bearings 52*a*, 52*b* along the rear slot sides 73 of the bearing insertion slots 7*a*, 7*b* in the direction leaving the bearing insertion slots 7*a*, 7*b*. The platen roller 5 can therefore be easily removed.

The lock levers 8*a*, 8*b* can also be moved with little force to the unlocked position by using the lock release lever 10. This also simplifies the task of removing the platen roller 5.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A thermal printer comprising:

a main frame;

a thermal head that is installed in the main frame;

a platen roller that is removably installed in the main frame and that has a roller shaft and a platen bearing mounted on the shaft;

a head urging member that urges the thermal head against the platen roller in a first direction from a first side to a second side;

a bearing insertion slot that is formed in the main frame; and a lock lever that urges the platen bearing in a second direction from the second side to the first side and that locks the platen bearing in the bearing insertion slot; wherein the bearing insertion slot has a flat bottom surface which is extended in the first direction, a first side surface that is extended from the first side of the bottom surface, and a second side surface that is extended from the second side of the bottom surface;

the lock lever has a contact surface that contacts with the platen bearing, the contact surface being a concave surface, and a curvature of the contact surface being less than a curvature of an outside diameter of the platen bearing;

when the lock lever is in a locked position locking the platen bearing in the insertion slot, the roller shaft of the platen roller contacts the first side surface, the second side surface, and the flat bottom surface; and when the lock lever is in an unlocked position in which the platen bearing is not locked in the insertion slot, the roller shaft of the platen roller contacts the second side surface and the flat bottom surface and does not contact the first side surface.

2. The thermal printer described in claim 1, wherein:

the first side surface has a concave surface part that curves toward the second direction and a convex surface part that continues from a top end of the concave surface part and projects toward the first direction.

3. The thermal printer described in claim 1, wherein:

the second side surface has a first inclined part that extends at an angle of greater than 90 degrees from the bottom surface and a second inclined part that curves upward continuously from a top of the first inclined part.

4. The thermal printer described in claim 3, further comprising:

a support shaft disposed to the main frame; and a lock release lever supported by the support shaft that releases the lock lever from the locked position, wherein the lock lever is supported by the support shaft, and when the lock release lever releases the lock lever, an urging force of the head urging member pushes the platen bearing along the first inclined part of the second side surface.

5. The thermal printer described in claim 4, wherein:

the platen bearing of the platen roller is supported on the bottom surface of the bearing insertion slot, the first side surface of the bearing insertion slot, and the first side surface of the hook.

6. The thermal printer described in claim 3, wherein:

a gap between the first side surface and the second side surface is greater than an outside diameter of the platen bearing and increases to an upper side from the bottom surface.

* * * * *